United States Patent [19]

Villari et al.

[11] 3,994,021

[45] Nov. 30, 1976

[54] PROTECTIVE HELMET

[75] Inventors: Frank K. Villari, Oak Park; Carl J. Steigerwald, Wauconda; Frederick A. Rappleyea, Park Ridge, all of Ill.

[73] Assignee: The Kendall Company, Boston, Mass.

[22] Filed: June 5, 1975

[21] Appl. No.: 584,088

[52] U.S. Cl. ..... 2/413

[51] Int. Cl.[2] ..... A42B 3/00

[58] Field of Search ..... 2/3 R, 6, 8, 9, 10, 2/177, 202; 137/223, 225, 230; 273/65 A; 9/346; 267/113, 117

[56] References Cited

UNITED STATES PATENTS

| | | | |
|---|---|---|---|
| 1,833,708 | 11/1931 | Ford | 2/3 R |
| 2,618,780 | 11/1952 | Cushman | 2/3 R |
| 3,600,714 | 8/1971 | Cade et al. | 2/3 R |
| 3,761,959 | 10/1973 | Dunning | 2/3 R |

*Primary Examiner*—G. V. Larkin

*Attorney, Agent, or Firm*—Powell L. Sprunger

[57] ABSTRACT

A protective helmet comprising a shell, and flexible liner means positioned in the shell to dissipate forces applied against the helmet, with the liner means having fluid filled chamber means and a plurality of openings extending through the liner means. The helmet also has a plurality of resilient pad means positioned in the openings with at least a portion of the inner surfaces of the pad means being spaced from an inner surface of the liner means.

66 Claims, 27 Drawing Figures

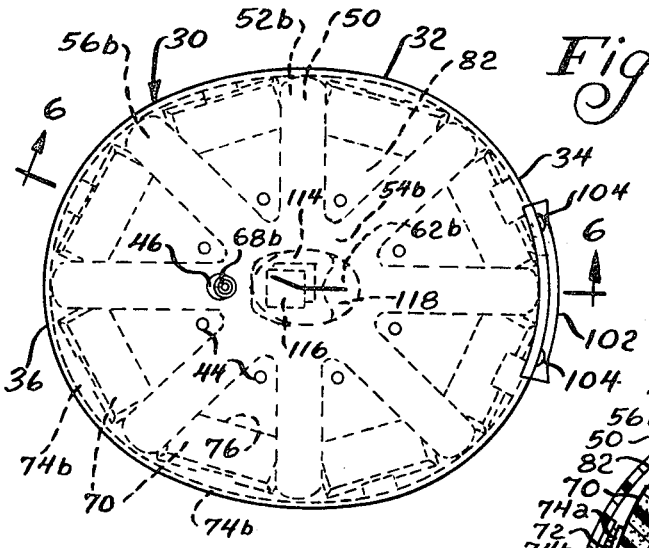
Fig. 5
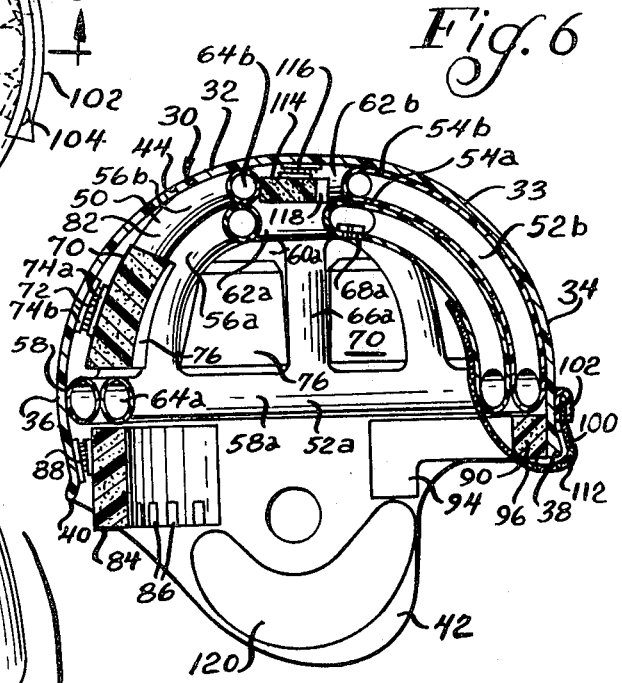
Fig. 6
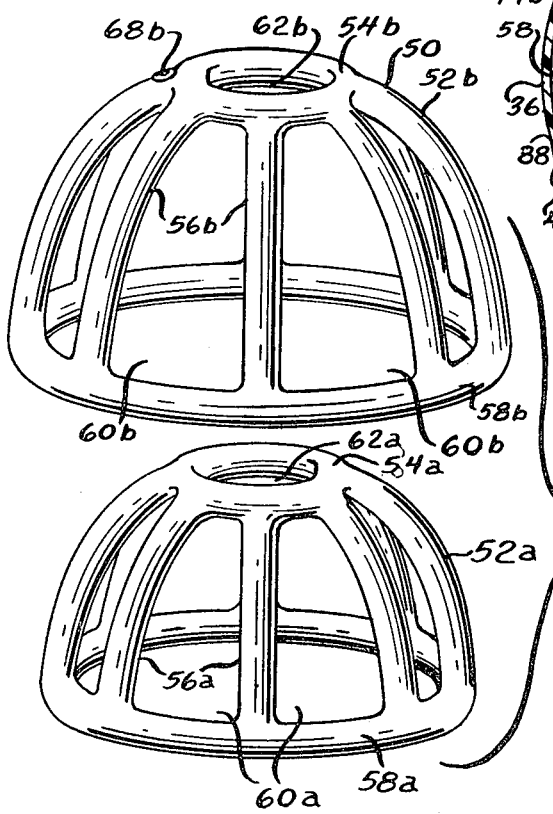
Fig. 7
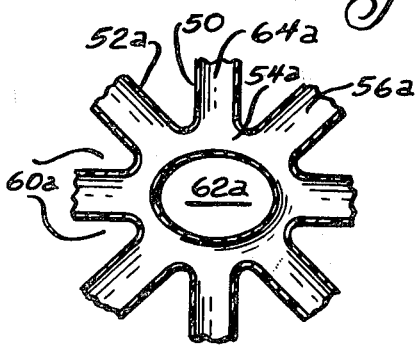
Fig. 8
Fig. 9
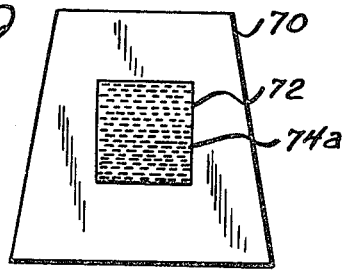

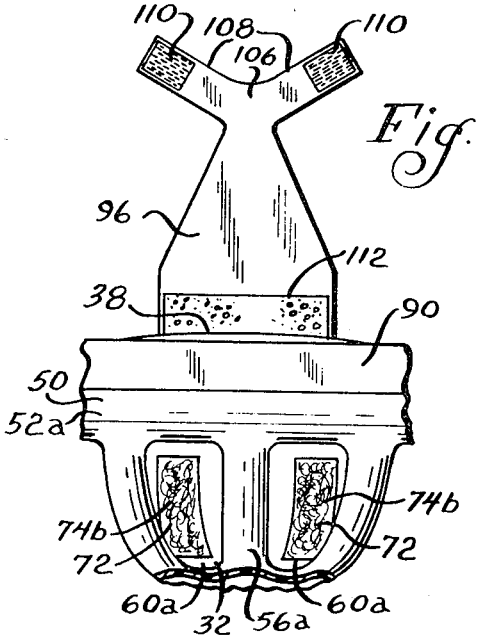
Fig. 11
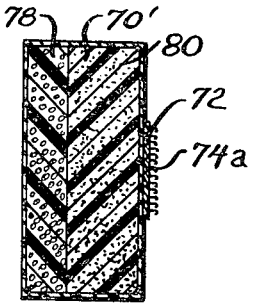
Fig. 10
Fig. 12
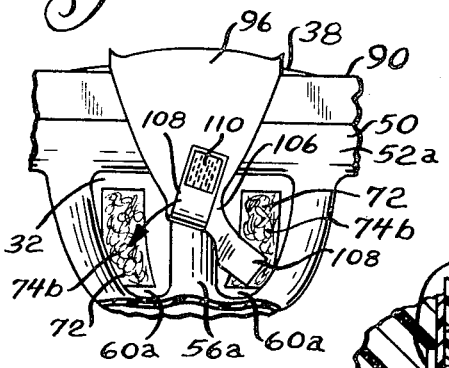
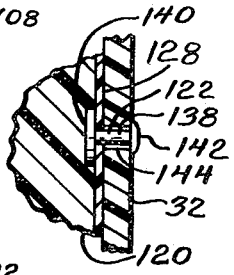
Fig. 15
Fig. 13
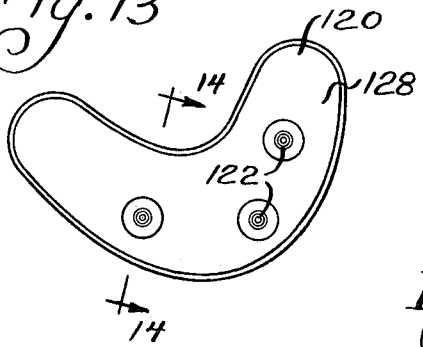
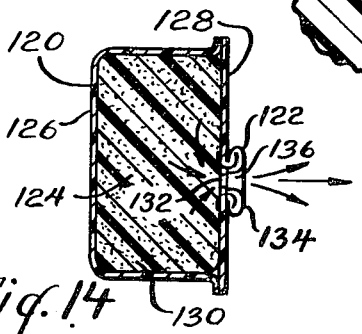
Fig. 14
Fig. 16
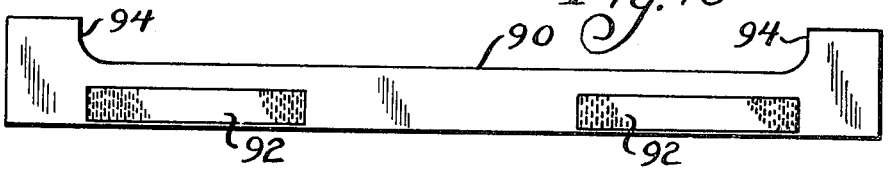
Fig. 17
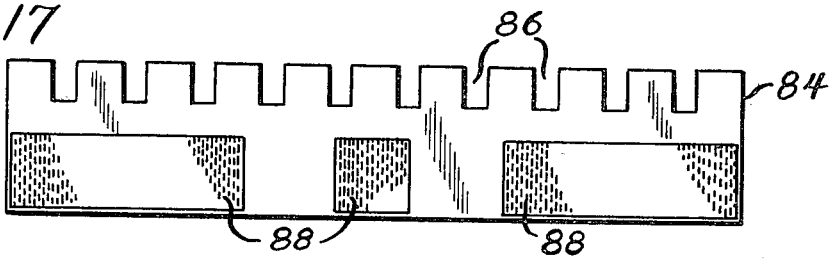

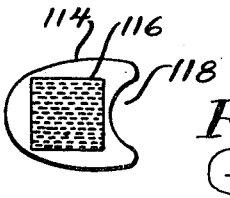
Fig. 18
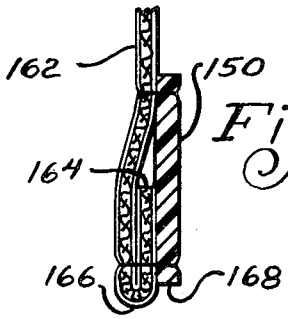
Fig. 21
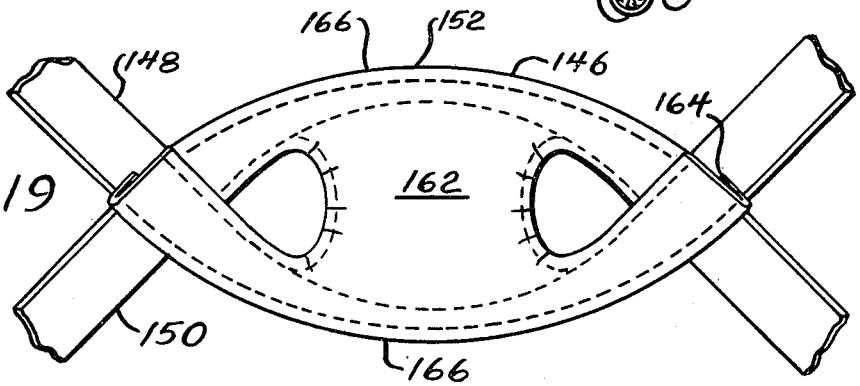
Fig. 19
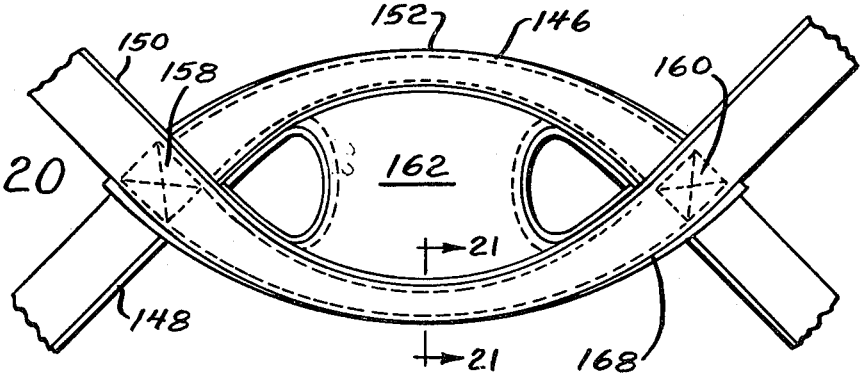
Fig. 20
Fig. 22
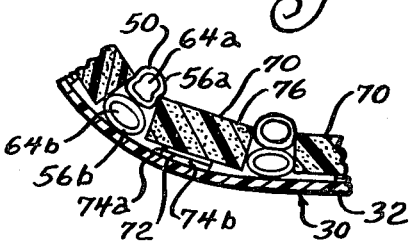
Fig. 23
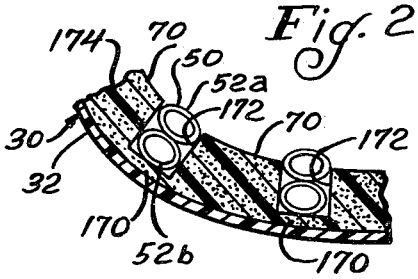

PROTECTIVE HELMET

BACKGROUND OF THE INVENTION

The present invention relates to protective equipment, and more particularly to protective headgear.

A various assortment of protective headgear of helmets has been proposed in the past for protecting the wearer's head in the event of a collision. Such helmets have been widely utilized by participants in a number of sports, where the possibility of head injury is great, such as football, hockey and baseball, and for other purposes, such as crash helmets. At an earlier time, it was somewhat unclear how much protection the helmets actually afforded to the user, and, if the wearer suffered a head injury in spite of the helmet, it apparently was accepted that the shock to the head resulting from the impact may have been greater than could reasonably be protected by the headgear.

More recently, technology has been applied to determine exactly what happens to the wearer's head when the helmet is subject to impact. In particular, tests have been devised to measure the forces which are actually transmitted to the head responsive to a blow against the helmet. For example, drop tests are currently being used to determine these forces. An accelerometer may be placed in a metal head form, and the helmet to be analyzed is fitted and placed on the form. The helmet and form assembly are then raised to a height above a striking surface, after which the assembly is dropped against the surface, with information from the accelerometer being recorded during this time. Of course, the assembly may be adjusted to select the desired impact point on the helmet. The data from the input axis of the acccelerometer may be translated to the vertical drop axis to determine the forces which are transmitted through the helmet to the form. In this manner, a given helmet may be analyzed to learn whether it will perform adequately under conditions of use.

It has been found that in many cases current helmets do not afford the amount of protection expected or desired. Accordingly, a considerable amount of effort has beeen expended to make protective headgear which laboratory tests demonstrate provide the wearer a maximum amount of protection. Additionally, other factors must be considered in arriving at a totally satisfactory helmet.

First, the helmet should be properly fitted for the wearer during use, or the completely satisfactory test results may vary from the actual conditions when the helmet is worn in the field. Proper fitting of the helmets has been fairly difficult to attain due to the numerous head sizes which must be fitted. Of course, helmets could be tailor made for an individual, but, as a practical matter, such a procedure proves unnecessarily burdensome from a standpoint of convenience, time, and cost. Alternatively, it is desirable that the helmets may be adjustable throughout a range of sizes, particularly if the desirable force dissipating characteristics of the helmets are not compromised.

Additionally, the helmet should be comfortable when worn. If the inner portion of the helmet which contacts the wearer's head is too hard, the wearer may suffer headaches or other discomfort as a result of use, and the wearer may refuse to utilize the headgear in spite that it may be superior in all other respects. As will be seen below, the protective headgear of the present invention solves the above difficulties, and provides a helmet which is superior from the standpoint of force dissipation, comfort and fit.

SUMMARY OF THE INVENTION

A principal feature of the present invention is the provision of a protective helmet which has improved energy absorbing capabilities to dissipate forces applied against the shell.

The helmet of the present invention comprises, a shell, and flexible liner means positioned in the shell to dissipate forces applied against the helmet. The liner means has fluid filled chamber means and a plurality of openings extending through the liner means. The helmet also has a plurality of resilient pad means positioned in the openings with at least a portion of the inner surfaces of the pad means being spaced from an inner surface of the liner means. In a preferred embodiment, the liner means includes a first inner liner of flexible material having first fluid filled chamber means, and a second liner positioned intermediate the first liner and the shell and having second fluid filled chamber means positioned intermediate the first chamber means and the shell. Also, in a preferred form the resilient pad means abut against opposed side walls of the liner means defining the openings.

A feature of the present invention is that the resilient pad means retains the liner means in position within the shell, and prevents slippage of the liner means relative the shell.

Another feature of the invention is the provision of means for releasably attaching the pad means to the inside of the shell.

A further feature of the invention is that the liner means and pad means may be readily positioned within and removed from the shell.

Still another feature of the invention is that the pad means absorbs energy responsive to an impact against the helmet when the inner surface of the liner means is depressed below the inner surface of the pad means.

A feature of the invention is that the pad means confines regions of the liner means and provides a smooth energy absorbing transition between the liner means and the pad means.

A further feature of the invention is that the first and second liners have different rigidities to dissipate varying levels of forces applied against the shell.

Thus, another feature of the invention is that the first and second liners and resilient pad means co-operate to dissipate varying levels of forces applied against the shell.

Yet another feature of the invention is that the first linrt has relatively soft conformable and comfortable inner surface for contacting the wearer's head.

Another feature of the invention is that the first and second liners may be inflated to comfortably fit the helmet to a relatively wide range of head sizes without loss of protection to the wearer.

A feature of the invention is the provision of a sweet band having one end secured to the outside of the shell and its other end releasably secured to the inside of the shell.

Another feature of the invention is that the sweat band assists in maintaining the liner means and a front resilient pad of the helmet in position within the shell.

Still another feature of the invention is that the inner end of the sweat band is partially retained in place through use of the pad means.

Another feature of the invention is the provision of a chin strap for the helmet having a chin cup with relatively soft side edges for comfort and protection to the wear.

Further features will become more fully apparent in the following description of the embodiments of this invention and from the appended claims.

DESCRIPTION OF THE DRAWINGS

In the drawings:

FIG. 5 is a top plan view of the helmet of FIG. 1;

FIG. 6 is a sectional view taken substantially as indicated along the line 6—6 of FIG. 5;

FIG. 7 is an exploded perspective view of nestable liners for the helmet of FIG. 1;

FIG. 8 is a fragmentary sectional view of an upper central portion of one of the liners of FIG. 7;

FIG. 9 is a plan view of a retainer pad for the helmet of FIG. 1;

FIG. 10 is a sectional view of an embodiment of the retainer pad of FIG. 9;

FIG. 11 is a fragmentary inner view of a front portion of the helmet, and showing an end of a sweet band before being positioned inside of the helmet;

FIG. 12 is a fragmentary inner view of the helmet of FIG. 11 showing the sweat band as partially secured to an inner portion of the helmet;

FIG. 13 is a plan view of a jaw pad for the helmet of FIG. 1;

FIG. 14 is a sectional view of the jaw pad taken substantially as indicated along the line 14—14 of FIG. 13;

FIG. 15 is a fragmentary sectional view showng an embodiment of securing means for the jaw pad of FIGS. 13 and 14;

FIG. 16 is a plan view of a front pad for the helmet of FIG. 1;

FIG. 17 is a plan view of a rear pad for the helmet of FIG. 1;

FIG. 18 is a plan view of an upper retainer pad for the helmet of FIG. 1;

FIG. 19 is a fragmentary top plan view of a chin strap for the helmet of FIG. 1;

FIG. 20 is a fragmentary bottom plan view of the chin strap of FIG. 19;

FIG. 21 is a fragmentary sectional view of the chin strap taken substantially as indicated along the line 21—21 of FIG. 20;

FIG. 22 is a fragmentary sectional view taken substantially as indicated along the line 22—22 of FIG. 1;

FIG. 23 is a fragmentary sectional view of another embodiment of the helment;

DESCRIPTION OF THE PREFERRED EMBODIMENTS

Figure 1:
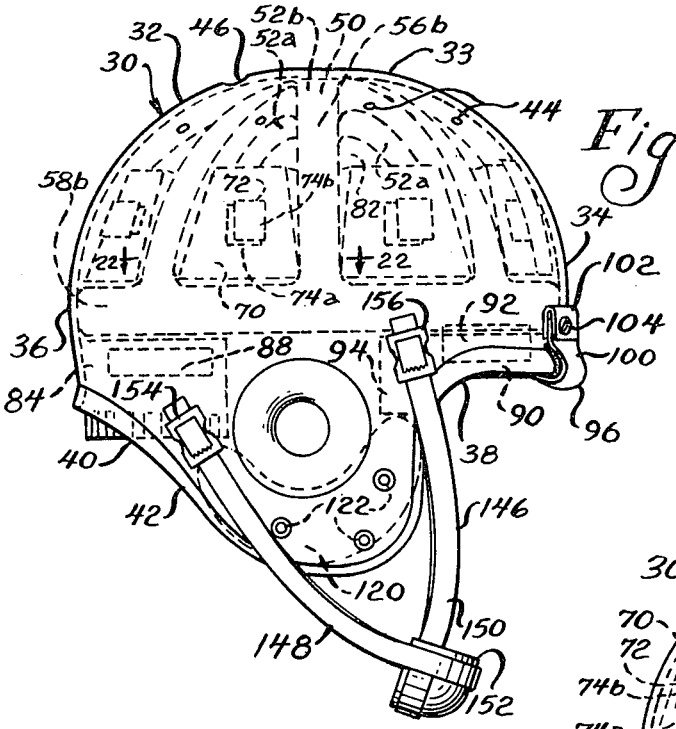
FIG. 1 is a side elevational view of a protective helmet or headgear.
Figure 2:
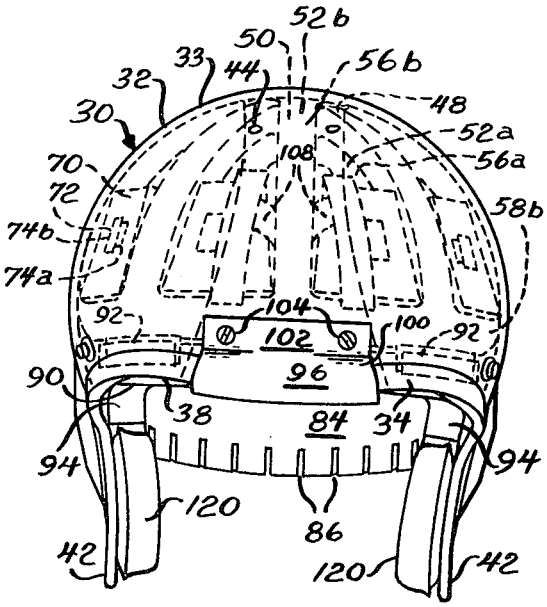
FIG. 2 is a front elevational view of the helmet of FIG. 1.
Figure 3:
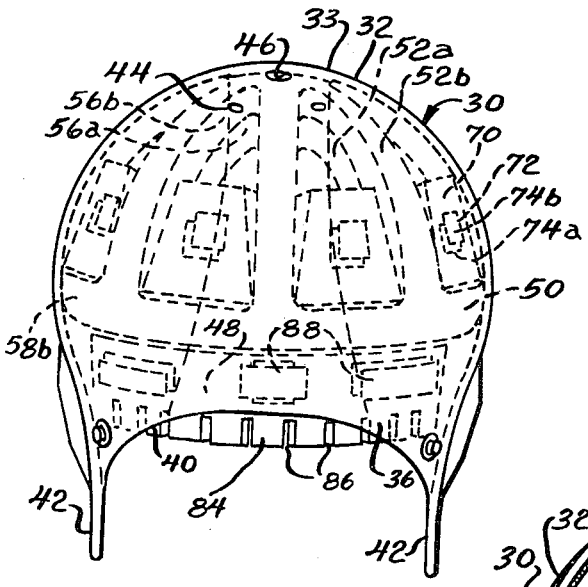
FIG. 3 is a rear elevational view of the helmet of FIG. 1.
Figure 4:
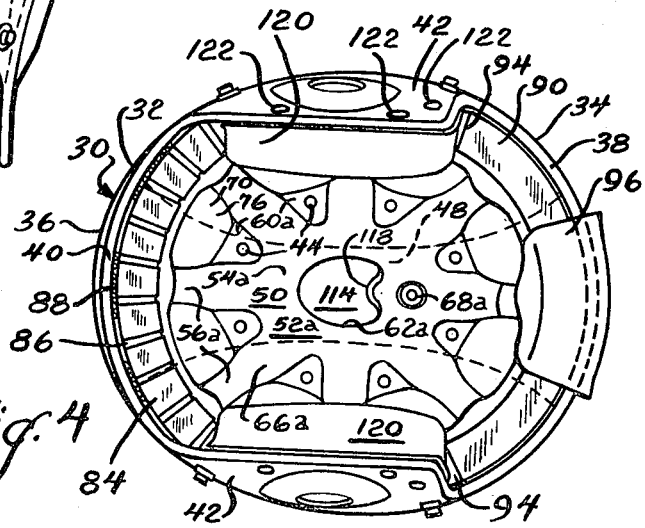
FIG. 4 is a bottom plan view of the helmet of FIG. 1.

Refelrring now to FIGS. 1–6, there is shown a protective helmet generally designated 30. Although the helmet 30 is shown in the form of a football helmet, it will be understood that the principles of the invention may be utilized in connection with any other suitable headgear, such as hockey helmets, baseball helmets, crash helmets, or other headgear where protection of the head is desired. As shown, the helmet 30 has an outer shell 32 which is preferably made of a relatively rigid material, such as a polycarbonate alloy, a rigid thermoplastic, or a thermosetting resin. The shell 32 has an upper central portion 33, a front portion 34, a rear portion 36, a lower front edge 38, a lower rear edge 40, and a pair of ear protectors 42. The shell 32 also has a plurality of ventilating apertures 44 extending through and spaced around an upper portion of the shell, and an opening 46 extending through the shell which will be further described below. As best shown in FIG. 2–4, the shell 32 may include a region 48 of increased thickness in the longitudinal central area of the helmet or other area of the helmet, such as in the ear protectors 42, to provide additional reinforcement to the shell where holes may be placed in the shell.

The helmet 30 also has a flexible liner means or cradle 50 positioned in the shell 32 to dissipate forces applied against the helmet. Referring to FIGS. 6–8, the liner means 50 has a pair of first and second nestable flexible liners or cushions **52*a* and 52*b*, respectively. The first and second liners 52*a* and *b* respectively have a hollow annular member 54*a* and 54*b* adjacent an upper central portion of the respective liner, a plurality of hollow spaced spoke members 56*a* and 56*b* extending from and communicating with the annular member 54*a* or *b* of the respective liner, and a hollow rim 58*a* and 58*b* extending peripherally around a lower end of the respective liner and communicating with the respective spoke members 56*a* or *b*. As shown, side walls of the spoke members 56*a* and *b* and rims 58*a* and *b* define a plurality of openings 60*a* and 60*b* having the general shape of isosceles triangles extending through the respective liner. Also, the annular members 54*a* and *b* define generally circular shaped openings 62*a* and 62*b* extending through the upper central portion of the respective liner, with the sidewalls of the liners defining the openings 62*a* and *b*** preventing overinflation or bulging of the upper central portions of the liners.

As best shown in FIGS. 6 and 8, the hollow first liner **52*a* defines first chamber means 64*a* communicating between the annular member 54*a*, the spoke members 52*a*, and the rim 58*a*. Similarly, the second liner 52*b* defines second chamber means 64*b* communicating between the annular member 54*b*, the spoke members 56*b*, and the rim 58*b*. In a preferred form, the first and second chamber means 64*a* and *b* of the first and second liners 52*a* and *b*, respectively, are inflated with a gas, such as air, although the second chamber means 64*b* of the second liner 52*b*** may be filled with a liquid to provide additional rigidity to the second liner, if desired.

As best shown in FIG. 6, the first liner **52*a* is nested within the second liner 52*b*, with the spoke members 56*a* and *b*, annular members 54*a* and *b*, and rims 58*a* and *b* of the two liners 52*a* and *b***, as well as the first and second chamber means, being generally in alignment.

In this configuration, the openings 60*a* and *b* and 62*a* and *b* of the two liners are also in alignment, such that the openings extend completely through the liner means 50. As will be seen below, the inner liner 52*a* defines a soft conformable inner surface 66*a* for contacting the wearer's head. As shown in FIGS. 4 and 6, the first liner 52*a* has lower valve means 68*a* of known type for inflating the first chamber 64*a* through the inside of the helmet, while the second liner 52*b* has upper valve means 68*b* for inflating the second chamber 64*b* through the opening 46 in the shell 32, as illustrated in FIG. 5. The first liner 52*a* may be removably positioned within the second liner 52*b*, and may be secured to the second liner, if desired, by suitable means, such as adhesive, hook and loop strips, or bands extending around the spoke members of the nested liners.

In a preferred form, the liners 52*a* and *b* are rotomolded, and are made from any suitable flexible or elastic material, such as polyvinyl chloride plastisol, ethylene vinyl acetate, polyethylene, or liquid polyurethane. Preferably, the inner first liner 52*a* has a durometer hardness less than the durometer hardness of the second liner 52*b*, although rigidity may be added to the second liner by filling it with liquid. In a suitable structure of the liners, the inner liner 52*a* has a shore hardness in the range of 45–55, while the shore A hardness of the second liner 52*b* may be in the range of 75–90. If both liners are inflated with a gas, the modulus of elasticity of the inner liner is preferably less than that of the outer liner, such that the inner liner provides a relatively soft conformable inner surface 66*a* for contacting the wearer's head in a comfortable manner. The inner liner 52*a* readily compresses and absorbs energy in the helmet, while providing continued comfort to the wearer, resulting from impacts of relatively low force levels against the shell. The second liner 52*b* provides a more rigid structure to dissipate higher level forces applied against the shell. Thus, the liners 52*a* and b co-operate to absorb energy resulting from impacts against the shell of varying force levels, with the liners compressing or deforming different amounts at the point of impact, such that the forces are dissipated in an improved manner to protect the wearer while providing continued comfort to the wearer.

Referring now to FIGS. 6 and 9, there is shown a plurality of resilient retainer pads 70 having a generally trapezoidal shape. The retainer pads 70 may be made of any suitable material, such as a closed cell polyvinyl chloride foam of medium density, for example, Ensolite, a trademark of Uniroyal, or, Rubatex, a trademark of Great American Industries. The pads 70 may have their outer surfaces treated to provide washable surfaces of the pads, for example, by dipping the pads in a suitable material, such as a liquid vinyl, urethane, or latex.

As illustrated in FIGS. 1–6 and 22, a plurality of the retainer pads 70 are positioned in the aligned openings 60*a* and *b* of the first and second liners 52*a* and *b*, with the enlarged portion of the pads being located adjacent the bases of the triangular shaped openings 60*a* and *b*. The pads 70 may be releasably attached to the inside of the shell 32 by suitable securing or fastening means 72 to maintain the pads 70 in place between the spoke members 56*a* and *b* of the first and second liners 52*a* and *b*. The fastening means 72 may comprise a hook and loop arrangement of known type, such as a pair of interengaging hook and loop strips 74*a* and 74*b*, with one strip 74a being secured to a back surface of the pads 70, and with the other strip 74*b* being secured to the inner surface of the shell 32. The pads 70 may be attached in the liner openings by passing the pads through the openings and engaging the strips 74*a* on the pads against the strips 74*b* on the shell to interengage the strips of the fastening means 72. The pads 70 may be removed from the openings by pulling on the upper ends of the pads to release the strips 74*a* on the back of the pads from the strips 74*b* on the inside of the shell.

As shown in the drawings, each of the retainer pads 70 extends between adjacent spoke members 56*a* and *b* of the liner means 50, such that the inclined sides of the pads abut against side walls of the spoke members defining the openings 60*a* and *b* of the liner means 50. Since the retainer pads 70 are secured to the shell 32, the pads prevent rotational movement or slippage of the liners 52*a* and b within the shell 32. Also, the sides of the pads 70 frictionally engage the spoke members 56*a* and *b*, and the pads 70 prevent upward movement of the shell 32 relative the liner means 50. Accordingly, the liners 52*a* and *b* are held firmly in place by the pads 70 within the shell. In this regard, it should be noted that the pads 70 extend a sufficient distance inwardly from the shell to engage side walls of the spoke members 56*a* of the inner first liner 52*a*, although the inner surfaces 76 of the pads 70 are spaced slightly from the inner surface 66*a* of the liner means 50.

The retainer pads 70 also confine the spoke members 56a and *b* of the first and second liners 52*a* and *b* at a location intermediate the pads 70. Thus, the pads limit the amount of expansion permitted by the spoke members intermediate the pads, and facilitate the liners in absorbing energy from an impact. When a force is applied against the shell, particularly in the region of the pads 70, the first and second liners 56*a* and *b* deform somewhat and the fluid in the chambers is compressed in the region of the impact. However, since expansion of the liners is confined in this area by the pads 70, deformation of the liners is reduced, and the liners provide greater impact resistance or cushioning effect in this region. Similarly, if the force is applied to an upper part of the shell 32, fluid passes from the region of the impact toward the lower portion of the liners, and the pads 70 limit expansion of the spoke members to obtain greater resistance to fluid compression in the region of the blow. In this manner, the retainer pads 70 provide additional buoyancy or resiliency to the liner means in order to dissipate forces applied against the shell.

As previously noted, the inner surfaces 76 of the retaining pads 70 are spaced slightly from the inner surface 66*a* of the first liner 52*a*. If a particularly hard impact is applied against the shell, such that the inner surface 66*a* of the liner 52a is depressed below the inner surfaces 76 of the pads 70, the retainer pads 70 then serve to absorb energy of the blow. In this case, the retainer pads 70 cushion the blow, and prevent the wearer's head from deforming the liners to a location adjacent the inner surface of the shell 32. In this manner, the first and second liners 52*a* and *b* and retainer pads 70 co-operate to absorb energies resulting from a blow to the helmet. At relatively low impact levels, the soft inner liner 52*a* cushions these blows without the inner surface 66*a* of the inner liner being depressed to a position below the inner surfaces 76 of the pads 70, although, in this instance, the second liner 52*b* may be slightly compressed and contributes in dissipating such forces. At higher level impacts, the more rigid second liner 52*b* provides a second level of energy absorption to dissipate such forces. If the impact is of sufficient magnitude, the inner surface 66*a* of the liner means 50 may be depressed below the inner surfaces 76 of the retaining pads 70 in the region of the blow, and the liners and pads 70 co-operate to absorb the great amount of energy from this blow. Since the pads 70 confine the spoke members 56*a* and *b* of the liners intermediate the pads, the pads cause a smooth transition of energy absorption by the liner means itself and by the liner means in combination with the retainer pads 70. Throughout this time, the inner liner 52*a* provides a soft comfortable surface for the wearer's head, and the retainer pads 70 are made of a relatively soft material to also provide a comfortable surface for the head when they are contacted as a result of a relatively hard blow to the helmet.

Another embodiment of the retainer pads is illustrated in FIG. 10, in which like reference numerals designate like parts. As before, the retainer pads 70' may have a generally trapezoidal shape, fastening means 72 for securing the pads to the inner surface of the shell, and a washable surface or coating. In this embodiment, the pads 70' have a first inner section 78 of relatively soft resilient material for contacting the wearer's head, such as the material described in connection with the pads of FIG. 9, and a second outer section 80 of relatively stiff resilient material. The section 80 may be made of any suitable material, such as a rubber and polyvinyl chloride foam composition, for example, a material distributed under the trademark De Cello by David Freeland and Associates, Inc. of Detroit, Mich. The pads 70' of FIG. 10 provide the helmet with a still higher level of energy absorption capability. When the pads 70' are contacted more lightly by the wearer's head, the relatively soft inner section 78 sufficiently absorbs shock in the helmet. However, when an extremely hard impact is applied against the shell and the wearer's head engages against the retainer pads 70' with a relatively high force, the second stiff sections 80 of the pads absorb energy from the blow, while the soft inner sections 78 of the pads cushion the wearer's head during the hard blow.

As illustrated in FIGS. 4, 5, 6, and 18, the helmet 30 also has a resilient pad 114 which is releasably positioned in the openings 62*a* and *b* of the liner means 50. The pad 114 may be made of any suitable material, such as the material described in connection with the retainer pads 70 or 70' above, and may have a suitable coating of washable material, as described above. The pad 114 and the shell 32 have suitable fastening means 116, such as the hook and loop strips discussed above, to releasably attach the pad 114 to the inside of the shell within the liner openings. The pad 114 may generally conform with the shape of the openings 62*a* and *b*, and may have a cutout 118 adjacent one end to facilitate removal of the pad 114 from the liner means. The upper pad 114 also serves to retain the liner means in its proper position within the shell 32, and to absorb energy from high level impacts against the helmet.

As best shown in FIGS. 1, 5 and 6, the upper ends of the retainer pads 70 are spaced from the annular members 54*a* and b of the first and second liners 52*a* and *b*, respectively, and define open regions 82 of the liner openings 60*a* and *b*. As shown, the ventilating openings 44 in the shell 32 communicate between the open regions 82 and the outside of the shell. Thus, air is permitted to circulate between the inside and the outside of the shell to ventilate the inside of the helmet while being worn.

As shown in FIGS. 1, 3, and 6, the rims 58a and b of the liner means 50 are spaced above the lower rear edge 40 of the shell 32. As shown in FIG. 17, an elongated rear sizer pad 84 is provided for placement in the lower rear portion of the shell. The pad 84 may be made of any suitable resilient material, such as the closed cell foam material described above in connection with the retainer pads 70 of FIG. 9, and may have a washable coating. The pad 84 preferably has a plurality of longitudinally spaced cutouts 86 to permit bending of the pad without wrinkling when placed in the shell. As shown in FIGS. 1, 3, and 6, the rear pad 84 is positioned below the liner means in the shell, and extends around a lower rear portion of the shell 32. The pad 84 may be releasably attached to the inner surface of the shell 32 by suitable fastening means 88, such as hook and loop strips, discussed above in connection with the pads 70, spaced longitudinally along the back surface of the pad and around the lower rear inner surface of the shell. Thus, the rear pad 84 is secured to the shell below the liner means 50 by pressing the pad against the shell to interengage the hook and loop strips of the fastening means 88. As shown, a lower portion of the rear pad 84 extends below the lower rear edge 40 of the shell 32. Thus, the pad 84 cushions the wearer's head and neck from an impact against a lower rear portion of the shell, and the lower portion of the pad 84 prevents the wearer's neck from engaging against the lower rear edge 40 of the shell. Since the rear pad 84 is normally in contact with the wearer's head or neck, the thickness of the pad may be selected or sized to the particular contour of a wearer's head, in order to provide a better cushioning effect against the shell.

Referring now to FIGS. 1, 2, and 6, the rims 58*a* and *b* of the first and second liners 52*a* and *b* are also spaced above the lower front edge 38 of the shell 32. As illustrated in FIG. 16, an elongated resilient front pad 90 is provided to cushion the wearer's head adjacent the lower front portion of the shell. The pad 90 may be made of any suitable material, such as the closed cell foam material described above in connection with the retainer pads 70. Also, the outer surface of the front pad 90 may be coated with a washable material, as previously described. As shown in FIGS. 1, 2, 6, and 16, the front pad 90 is releasably attached to the lower front portion of the shell by suitable fastening means 92, such as by hook and loop strips described above, with strips of the material being spaced longitudinally along the back surface of the pad 90 and the lower inner surface of the shell 32. Accordingly, the pad 90 is secured in place by pressing the pad against the lower front portion of the shell, such that the hook and loop sections or strips of the fastening means 92 interengage and retain the pad in place. In this configuration, the pad 90 is located below the liner means 50, and extends around the lower front portion of the shell, with a lower surface of the front pad 90 being located adjacent the lower front edge 38 of the shell. As shown, the pad 90 has a pair of depending tabs 94 adjacent its opposite ends, such that the tabs 94 cover a front inner portion of the ear protectors 42 of the shell 32. The thickness of the front pad 90 may be selected to conform with the particular size of the wearer's head, as described above in connection with the rear pad 84.

Thus, the front pad 90 serves to absorb blows adjacent the lower front portion of the shell.

As shown in FIGS. 4 and 6, the helmet 30 has a sweat band 96 extending between the outside and the inside of the shell 32. The sweat band 96 may be made of any suitable material, such as a sheet of soft porous material which permits the transmission of water vapor through the sweat band. For example, the sweat band may be made from a poromeric polyvinyl chloride material having a reinforcement backing of woven material, such as a material sold under the trademark PORON by Rogers Corporation. As shown in FIGS. 1, 2, and 6, one end 100 of the sweat band 96 is received in an elongated U-shaped plastic retaining member 102, and the one sweat band end 100 and retaining member 102 are secured to the outside of the shell by suitable means, such as by a pair of spaced screws 104.

Referring now to FIGS. 11 and 12, the other end 106 of the sweat band has a pair of bifurcated tabs 108, with each of the tabs 108 having fastening means 110 for releasably attaching the tabs 108 to the fastening means 72 on the inside of the shell. The fastening means 110 comprises hook and loop strips which are compatible with the strips 74b on the inside of the shell, the latter being also utilized to secure the retainer pads 70 to the shell. As shown, the liner means 50 has aligned spoke members adjacent the front of the shell, with the fastening sections **74*b* under discussion being located in the liner openings on opposite sides of the front spoke members. As best shown in FIg. 12, the other end 106 of the sweat bend 96 is secured in place by attaching the fastening means 110 of the tabs 108 to the fastening strips 74*b* on opposite sides of the front spoke members of the liner means. Next, a pair of retainer pads 70 may be positioned in the liner openings on opposite sides of the front spoke members, and are secured in place over the tabs 108 by interengaging the fastening sections 74*a* on the back surfaces of the retainer pads 70 against the fastening strips 74*b* on the inside of the shell 32. Thus, the pads 70 facilitate retention of the tabs 108** against the inside of the shell.

In this configuration, the sweat band 96 extends around the lower front edge 38 of the shell 32, the frong pad 90, and the lower rims of the liner means 50, with the sweat band covering a portion of the front spoke members of the liner means, and with the tabs 108 of the sweat band 96 extending on opposite sides of the front spoke members. Accordingly, the sweat band 96 facilitates retention of the front pad 90 and the lower front portion of the liner means 50 in their proper place within the shell. As shown in FIGS. 6 and 11, the sweat band 96 also has a resilient pad 112 extending between the side edges of the sweat band, and being located intermediate the sweat band 96 and the lower front edge 38 of the shell 32. The pad 112 may be made of any suitable material, such as an open cell polyvinyl chloride foam. The pad 112 provides a cushion for the head over the lower front edge 38 of the shell.

Referring now to FIGS. 1, 2, 4, and 6, the helmet 30 has a pair of jaw pads 120 secured to the lower inner portion of the ear protectors 42 of the shell 32, with the lower surface of the jaw pads generally conforming with the lower edge of the ear protectors 42. The jaw pads 120 may be releasably attached to the ear protectors 42 by suitable fastening means 122, such as the hook and loop fasteners, discussed above, or male and female snap fasteners, as shown. Referring to FIGS. 13 and 14, the jaw pads 120 have an inner resilient pad 124 made of suitable material, such as open cell urethane foam. The pads 120 also have a front cover sheet 126 of a soft conformable material, such as a closed cell vinyl foam, and a back cover sheet 128 of suitable material, such as a sheet of vinyl, connected to the front sheet 126 adjacent sides of the pads 120. Thus, the front and back sheets 126 and 128 define an air chamber 130 covering the inner pad 124. As shown, the back sheet 128 has an opening 132, and the female fastener 134 of the fastening means 122 has an opening 136 extending through the fastener 134 and communicating with the opening 132 of the back sheet 128. Thus, air is permitted to pass through the fasteners between the chamber 130 and the outside of the jaw pads 120. Accordingly, the covered foam pads 124 are permitted to contract and expand during use of the helmet, and the fasteners 134 prevent the back sheet 128 from ripping or tearing around the back sheet openings 132.

Another embodiment of the fastening means 122 for the jaw pads 120 is illustrated in FIG. 15, in which like reference numerals designate like parts. In this embodiment, the fastening means 122 comprises a resilient fastening member 138. The fastening member 138 has a base 140 located inside the pad 120 behind the back sheet 128, and an enlarged outer head 142. Thus, the heads 142 of the fastening members 138 are passed through apertures 144 extending through the shell 32, until the heads 142 engage against the outer surface of the shell 32, and lock the jaw pads in place against the inner surface of the shell.

Referring now to FIG. 1, the helmet 30 also has a chin strap 146 to secure the helmet on the wearer's head. The chin strap 146 has a pair of retaining straps 148 and 150 which cross at lower space points to support a chin cup 152. As shown, ends of the straps 148 and 150 are slidably received in fastening elements 154 and 156, in order that the ends of the straps may be releasably secured to the outside of the shell at spaced locations to provide stability to the shell 32 when the helmet is worn. The distance between the chin cup 152 and the shell 32 may be modified by suitable adjustment of the straps 148 and 150 in the fastening elements 154 and 156.

Referring to FIGS. 19 and 20, the straps 148 and 150 may be secured together at the spaced crossing locations 158 and 160 by suitable means, such as by lines of sewing, and, the straps 148 and 150 are spaced apart in the region of the chin cup 152. The chin cup 152 has a sheet 162 of soft conformable material, such as the poromeric material described above in connection with the sweat band 96, extending between the spaced portions of the straps 148 and 150 in the cup. As best shown in FIG. 21, the lateral side margins 164 of the sheet 162 are folded over to a location against the straps, and the straps are secured to the sheet 162 and its side margins 164 by suitable means, such as by lines of sewing. Thus, the sheet 162 has side edges 166 which extend past side edges 168 of the relatively stiff straps. Since the sheet 162 faces the wearer's skin, the side edges 166 of the sheet 162 define soft edges for contacting the wearer's chin and prevent the straps from cutting the wearer's skin during use of the helmet.

The helmet may be assembled in the following manner. The first liner **52*a* is positioned within the second liner 52*b*, and the nested liners 52*a* and *b* are placed in the shell, with one of the aligned spoke members being located adjacent the forward portion of the shell. Next, the front and rear pads 90 and 84 may be secured in place below the liners at the lower front and rear portions of the shell to temporarily retain the liners in their desired position within the shell. The other end 106 of the sweat band 96 may be passed around the front pad 90 and the lower hollow rims of the liners, and the bifurcated tabs 108 are secured to the inside of the shell on opposite sides of the front spoke members of the liners. Next, the retainer pads 70 are attached to the shell through the openings 60***a* and *b* of the first and second liners 52*a* and *b* to retain the liners in their proper position within the shell, and the pad 114 may be attached to the shell through the upper openings 62*a* and *b* of the liner means. Finally, the jaw pads 120 may be secured to the inside of the ear protectors 42 of the shell 32.

The helmet may then be fitted to the particular size of the wearer's head. First, the inner first liner 52*a* may be inflated through the valve means 68a from the inside of the helmet prior to placing the helmet on the wearer's head. The extent to which the inner liner is inflated may depend somewhat upon the size of the head relative the shell. Next the helmet is placed on the wearer's head, and the helmet is secured in place on the head through use of the chin strap 146. Finally, the second liner 52*b* is inflated through the shell opening 46 and the valve means 68*b* from the outside of the shell while the helmet is secured on the wearer's head by the chin strap 146 to obtain a proper fitting on the helmet on the head. Thus, the second liner is inflated until the inner surface of the first liner contacts the head in a comfortable manner. In this manner, the inflatable liner means 50 and helmet may be adapted to varying head sizes. Of course, the helmet may be removed and the first inner liner may be inflated an additional amount if necessary to obtain a proper fit.

Another embodiment of the helmet 30 is illustrated in FIG. 23, in which like reference numerals designate like parts. In this embodiment, the helmet includes resilient connecting members 170 extending between the retaining pads 70, with the members 170 being located intermediate the liner means 50 and the shell 32. Thus, the pads 70 and connecting members 170 define a resilient third liner 174 having cutout portions 172 to receive the first and second liners 52*a* and *b*. The third liner 174 may be conveniently made of one-piece construction, for example, by molding the liner from a polystyrene foam or a radiated polyethylene foam, such that the retaining pads 70 project into the liner openings intermediate the spoke members of the liner means 50. The third liner 174 may have suitable cutouts to receive the spoke members, the annular members, and the rims of the first and second liners, as desired. Thus, the third liner 174 retains the inflatable first and second liners in position within the shell, and confines expansion of the liner means intermediate adjacent pads, in a manner as described above. Of course, the connecting members 170 of the third liner 174 provide additional energy absorbing capacity for the helmet intermediate the liner means and the shell 32.

Figure 24:
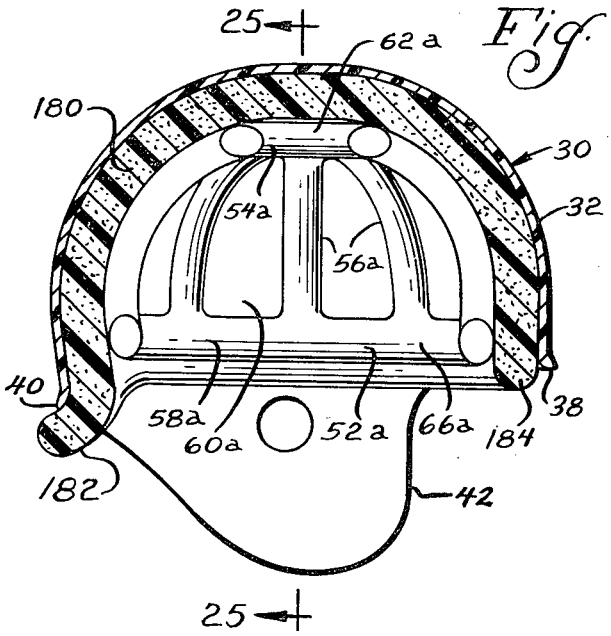
FIG. 24 is a side sectional view of another embodiment of a protective helmet.
Figure 25:
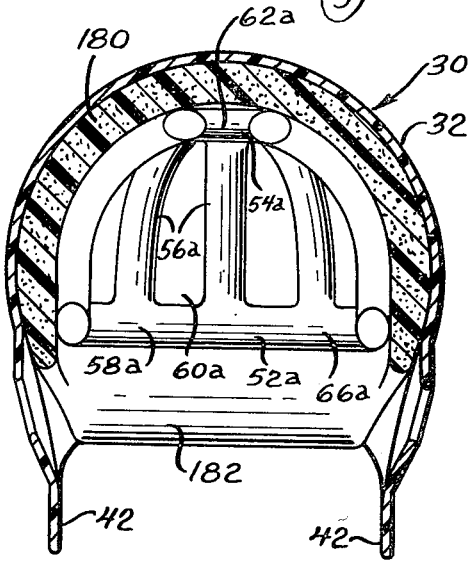
FIG. 25 is a sectional view taken substantially as indicated along the line 25—25 of FIG. 24.

Another embodiment of the helmet 30 is illustrated in FIGS. 24 and 25, in which like reference numerals designate like parts. In this embodiment, the helmet has a first inner line 52*a* similar to that described above in connection with the helmets of FIGS. 1–23. Thus, the inner liner has a plurality of hollow spoke members 56*a*, a hollow annular member 54*a* communicating with the spoke members adjacent an upper central portion of the liner 52*a*, and a hollow rim 58*a* communicating with the spoke members 56a at a lower portion of the liner 52*a*. The helmet 30 also has a second resilient liner 180 positioned intermediate the first liner 52*a* and the shell 32, with a lower rear portion 182 of the liner 180 extending below the lower rear edge 40 of the shell 32. The liner 180 may be made from any suitable material, such as a layer of closed cell vinyl foam of medium range density. The second liner 180 may be releasably secured within the shell by suitable means, such as a hook and loop fastening arrangement, as described above. Also, the first inner liner 52*a* may be retained in place within the second liner 180 by any suitable means, such as the retainer pads, discussed above, which may be releasably attached to the second liner 180 through the openings 60a defined by the first liner 52*a*. If desired, the second liner 180 may have a plurality of projections extending into the openings of the first liner 52a to retain the first liner in place. Of course, the liners may be secured in the helmet by a number of other types of fastening means. The helmet may also have a sweat band extending around a front portion of the helmet, as described above, and a pair of jaw pads secured inside the ear protectors 42 of the shell 32. As shown, a lower front portion 184 of the second liner 180 may be located adjacent the lower front edge 38 of the shell 32.

The first inner liner 52*a* is preferably made of a relatively soft material to provide a soft conformable inner surface 66*a* for contacting the wearer's head, and to absorb energy responsive to lower force levels applied against the helmet. The resilient second liner 180 assists the first liner 52*a* in dissipating forces, and primarily absorbs the energy responsive to higher level forces applied against the shell. The wearer's head is also protected adjacent the lower edges of the shell by the lower front and rear portions 184 and 182 of the second liner 180, as well as the rim 58*a* of the first liner 52*a*.

Figure 26:
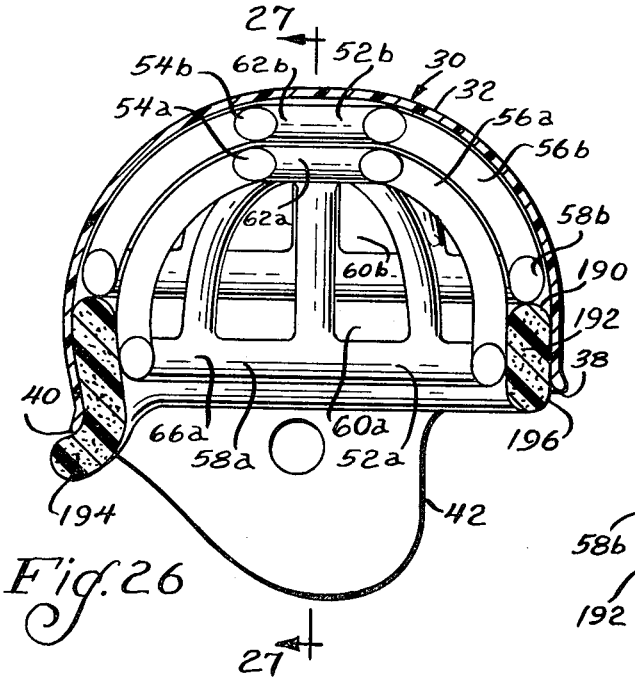
FIG. 26 is a side sectional view of another embodiment of a protective helmet.
Figure 27:
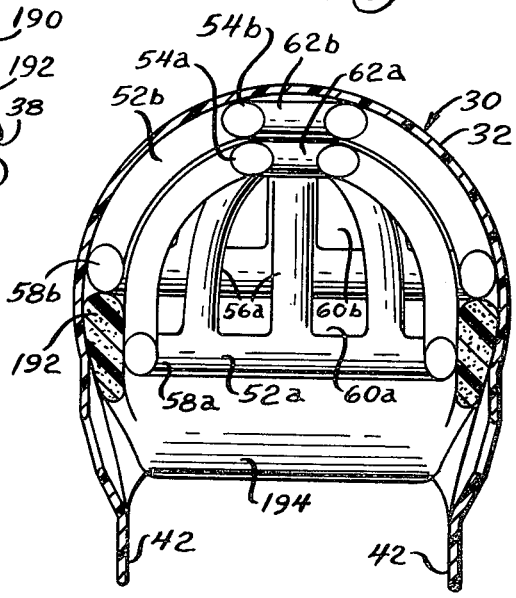
FIG. 27 is a sectional view taken substantially as indicated along the line 27—27 of FIG. 26.

Another embodiment of the helmet 30 is illustrated in FIGS. 26 and 27, in which like reference numerals designate like parts. In this embodiment, the helmet 30 has a pair of inflatable first and second liners 52*a* and 52*b* which are similar to the liners discussed above in connection with the helmets of FIGS. 1–23. As before, the first liner 52*a* may be made of a relatively soft material to provide a soft conformable inner surface 66*a* for contact with the wearer's head. The second liner 52*b* is positioned intermediate the first liner 52*a* and the shell 32, and may be made of a more rigid material to dissipate higher level forces applied against the shell. As discussed above, the first and second liners 52*a* and *b* have hollow annular members 54*a* and *b*, hollow spoke members 56*a* and *b* extending radially from the respective annular members 54*a* and *b*, and hollow rims 58*a* and *b* extending around a lower portion of the respective liner. However, in this embodiment, the rim 58*b* of the second liner 52*b* is spaced above the rim 58*a* of the first liner 52*a*, such that a space 190 is defined imtermediate the lower portion of the first liner 52*a* and the shell 32, and below the rim 58*b* of the second liner 52*b*.

As shown in the drawings, the helmet 30 has a third resilient liner 192 positioned in the space 190 and extending peripherally around a lower portion of the shell 32. Thus, the third liner 192 is positioned beneath the rim 58*a* of the first liner 52*a*, and below the rim 58*b* of the second liner 52*b*. The third liner 192 may be made of any suitable material, such as a closed cell vinyl foam. The third liner 192 preferably has a lower rear portion 194 extending below the lower rear edge 40 of the shell 32 to protect the wearer from contact against the lower rear edge of the shell. The lower front portion 196 of the third liner 192 may be located adjacent the lower front edge 38 of the shell 32. As previously described, the helmet may have a pair of jaw pads secured to the ear protectors 42, a sweat band extending between inner and outer front portions of the helmet, and retainer pads extending through aligned portions of the liner openings 60*a* and *b* and the liner openings 62*a* and *b*. The third liner 192 may be secured to the inner surface of the shell by suitable fastening means, such as a hook and loop arrangement between the third liner 192 and the shell, as previously described.

Thus, the first and second liners co-operate in a manner as previously described to dissipate forces of varying levels which may be applied against the shell. Also, the third resilient liner 192 co-operates with the lower portion of the first liner 52*a* to absorb energy responsive to impacts against the shell, particularly at the lower portion of the shell. At the same time, the inner liner 52*a* provides a comfortable surface for the wearer during use of the helmet.

The foregoing detailed description is given for clearness of understanding only, and no unnecessary limitations should be understood therefrom, as modifications will be obvious to those skilled in the art.

We claim:

1. A protective helmet, comprising: a shell, flexible liner means positioned in the shell to dissipate forces applied against the helmet, said liner means having fluid filled chamber means and sidewalls defining a plurality of openings extending through the liner means, and retaining means in said shell abuting against sidewalls of the liner means to prevent slippage of the liner means in the shell.

2. The helmet of claim 1 wherein the retaining means comprises resilient pad means positioned in a multiplicity of said openings.

3. The helmet of claim 2 including means for releasably attaching the pad means to the inside of the shell.

4. The helmet of claim 2 wherein at least a portion of the inner surfaces of the pad means are spaced from an inner surface of the liner means.

5. The helmet of claim 1 wherein at least a portion of the retaining means abuts against opposed sidewalls of the liner means defining an opening.

6. The helmet of claim 1 wherein the retaining means is positioned in contiguous openings of the liner means, and confines at least a portion of the liner means intermediate the contiguous openings against expansion.

7. The helmet of claim 1 wherein the chamber means comprises first fluid filled chamber means and second fluid filled chamber means intermediate the first chamber means and said shell.

8. A protective helmet, comprising: a shell, flexible liner means positioned in the shell to dissipate forces applied against the helmet, said liner means having a plurality of hollow elongated members, and resilient pad means positioned on opposite sides of a multiplicity of said elongated members to confine expansion of the elongated members intermediate the pads means.

9. The helmet of claim 8 wherein at least a portion of the inner surfaces of the pad means are spaced from an inneer surface of the liner means.

10. The helmet of claim 8 including means for releasably attaching the pad means to the inside of the shell.

11. The helmet of claim 8 wherein the pad means extend between sidewalls of contiguous elongated members.

12. The helmet of claim 8 wherein said elongated members have first and second fluid filled chamber means, with said second chamber means being located intermediate the first chamber means and said shell.

13. A protective helmet, comprising: a shell, flexible liner means positioned in the shell to dissipate forces applied against the helmet, said liner means having fluid filled chamber means and a plurality of openings extending through the liner means, and a plurality of resilient pad means positioned in said openings with at least a portion of the inner surfaces of the pad means being spaced from an inner surface of the liner means.

14. The helmet of claim 13 including means for releasably attaching the pad means to the inside of the shell.

15. The helmet of claim 13 wherein said pad means comprises a foam material.

16. The helmet of claim 15 wherein said pad means comprises a relatively soft closed cell foam material.

17. The helmet of claim 13 wherein at least a portion of said pad means has a first inner section of relatively soft resilient material, and a second outer section of relatively stiff resilient material.

18. The helmet of claim 17 wherein said first and second sections comprise a closed cell foam material.

19. The helmet of claim 13 wherein said pad means include a coating of a washable material.

20. The helmet of claim 13 wherein said pad means are spaced from the liner means in regions of the openings, and in which the shell includes ventilation openings communicating between the outside of the shell and said regions.

21. The helmet of claim 13 including resilient members connecting at least a portion of said pad means, with at least a portion of the connecting members being located intermediate the liner means and said shell.

22. The helmet of claim 21 in which said connecting members connect all of said pad means.

23. A protective helmet, comprising: a shell, flexible liner means positioned in the shell to dissipate forces applied against the helmet, said liner means having fluid filled chamber means and an annular member adjacent an upper central portion of the liner means defining an opening extending through the liner means, and resilient pad means positioned in said opening.

24. The helmet of claim 23 wherein the pad means generally conforms with the shape of said opening.

25. The helmet of claim 23 including means for releasably attaching the pad means to the inside of the shell.

26. The helmet of claim 24 and including means for releasably attaching the pad means to the inside of the shell, and wherein the pad means includes a cutout adjacent one end to facilitate removal of the pad means from the opening.

27. A protective helmet, comprising: a shell, flexible liner means positioned in the shell to dissipate forces applied against the helmet, said liner means having fluid filled chamber means and a plurality of generally isosceles triangular shaped openings extending through the liner means, with the bases of the triangular shaped openings being located adjacent a lower end of the liner means, and a multiplicity of generally trapezoidal shaped resilient pad means positioned in said openings, with sides of said pad means contacting sidewalls of the liner means defining sides of said openings.

28. A protective helmet, comprising: a shell, flexible liner means positioned in the shell to dissipate forces applied against the helmet, said liner means having fluid filled chamber means, a sweat band having one end secured to the outside of the shell adjacent the front of the helmet, said sweat band extending over a lower front edge of the shell and a portion of said liner means, and means for releasably attaching the other end of the sweat band to an inner portion of the shell.

29. The helmet of claim 28 wherein said liner means includes an elongated member extending between a lower and upper portion of the liner means adjacent the front of the shell, the sweat band has a pair of bifurcated tabs adjacent its other end, said sweat band covers a portion of the elongated members, and the attaching means releasably attaches said tabs to an inner portion of the shell on opposite sides of the elongated member.

30. The helmet of claim 28 including resilient pad means positioned between the lower front edge of the shell and said sweat band.

31. A protective helmet, comprising:

a shell;

a first inner liner of flexible material having a soft conformable inner surface for contacting the wearer's head, a plurality of hollow spoke members extending radially from an upper central portion of the first liner, and a hollow rim extending around a lower portion of the first liner, said spoke members and rim defining first fluid filled chamber means communicating between the spoke members and rim and defining a plurality of openings extending through the first liner;

a second liner of flexible material having a plurality of hollow spoke members extending radially from an upper central portion of the second liner, and a hollow rim extending around a lower portion of the second liner, said spoke members and rim defining second fluid filled chamber means communicating between the spoke members and rim and defining a plurality of openings extending through the second liner, said second liner being positioned intermediate the first liner and shell with the spoke members, rims and openings of the first and second liners generally in alignment, and said second liner being less deformable than the first liner responsive to a given force level applied against the helmet to dissipate higher level forces; and a plurality of resilient pads positioned in the openings of the first and second liners, said pads being secured to the shell and extending between sidewalls of adjacent spoke members to retain the liners in position in the shell, with at least a portion of the inner surfaces of said pads being spaced from an inner surface of the first liner.

32. The helmet of claim 31 including means for removably securing said pads to the shell.

33. The helmet of claim 31 in which the pads are positioned in all of said openings.

34. The helmet of claim 31 in which said spoke members of the first and second liners define generally isosceles triangular shaped openings and in which said pads have a generally trapezoidal shape.

35. The helmet of claim 31 wherein said pads are spaced from the liners in regions of the openings, and in which the shell includes a plurality of ventilation apertures extending between said regions and the outside of the shell.

36. The helmet of claim 35 wherein the pads are spaced from an upper portion of the liners to define said regions of the openings.

37. The helmet of claim 31 in which said first and second liners include a hollow annular member communicating with the respective spoke members adjacent an upper central portion of the respective liner, said annular members being generally aligned in the shell and defining a pair of aligned openings.

38. The helmet of claim 37 including a resilient pad positioned in the openings defined by the annular members of the first and second liners.

39. The helmet of claim 38 including means for releasably securing said pad to the inside of the shell.

40. The helmet of claim 31 including a pair of jaw pads releasably attached to lower ear protecting portions of the shell.

41. The helmet of claim 31 wherein the rims of the first and second liners are spaced from a lower rear edge of the shell, and including an elongated rear resilient pad removably secured to the inside of the lower rear portion of the shell, said rear pad extending around the lower rear portion of the shell and below the lower rear edge of the shell.

42. The helmet of claim 41 which the rear pad includes a plurality of cutouts spaced longitudinally along the pad to permit conformation of the pad to the shell.

43. The helmet of claim 31 in which the rims of the first and second liners are spaced from a lower front edge of the shell, and including an elongated front resilient pad removably secured to the inside of a lower front portion of the shell, said front pad extending around the lower front portion of the shell.

44. The helmet of claim 43 wherein the lower surface of the front pad is generally aligned with the lower front edge of the shell.

45. The helmet of claim 43 in which the front pad includes a pair of depending tabs adjacent opposed ends of the pad for partially covering lower ear protecting portions of the shell.

46. The helmet of claim 31 in which the first and second liners have a spoke member located adjacent the front of the shell, and including a sweat band having one end secured to the outside of the shell, and a pair of bifurcated tabs adjacent the other end of the band, said sweat band extending over a lower front edge of the shell and the rims of the liners, with said tabs being releasably attached to the inside of the shell on opposite sides of said front spoke members.

47. The helmet of claim 46 wherein a pair of said pads are removably secured to the shell over said tabs.

48. The helmet of claim 46 in which the rims of the frist and second liners are spaced from a lower front edge of the shell, including an elongated front resilient pad removably secured to the inside of a lower front portion of the shell, and in which said sweat bands extends over said front pad.

49. The helmet of claim 46 including a resilient pad located intermediate the sweat band and the lower front edge of the shell.

50. A chin protecting means for a protective helmet, comprising: a chin cup having a pair of spaced straps adjacent opposed lateral edges of the cup, and a sheet of soft flexible material having a doubled portion extending past the outer side edge of at least one of said straps, with a fold line in said doubled portion defining a soft conformable side edge of the cup for contact with the wearer's skin, and strap means connected to said cup for attaching the chin protecting means to the helmet.

51. A protective helmet, comprising: a shell, flexible liner means positioned in the shell to dissipate forces applied against the helmet, said liner means having fluid filled chamber means and a lower rear portion spaced above a lower rear edge of the shell, and an elongated resilient rear pad removably secured to the inside of a lower rear portion of the shell, said rear pad extending peripherally around the lower rear portion of the shell and below the lower rear edge of the shell.

52. A protective helmet, comprising: a shell, flexible liner means positioned in the shell to dissipate forces applied against the helmet, said liner means having fluid filled chamber means and a lower front portion spaced above a lower front edge of the shell, and an elongated resilient front pad removably secured to the inside of a lower front portion of the shell, said front pad extending around the lower front portion of the shell.

53. The helmet of claim 52 wherein said liner means includes a pair of laterally spaced openings positioned adjacent a front portion of the shell above said lower front edge, and a sweat band having a first end secured to the outside of the shell and a second end removably secured to the inside of the helmet in said openings, with the sweat band extending around the lower front edge of the shell and said front pad.

54. A protective helmet, comprising: a relatively rigid shell, liner means of a flexible material having fluid filled chamber means, a soft inner conformable surface for contacting the wearer's head, and a plurality of openings extending through the liner means, and a liner of resilient material positioned intermediate the liner means and the shell and having a multiplicity of inwardly extending pads positioned in the openings.

55. The helmet of claim 54 wherein the resilient liner comprises a layer of foam material.

56. The helmet of claim 54 wherein the liner means comprises a first inner liner having first fluid filled chamber means and a second liner positioned intermediate the first linear and the resilient liner and having second fluid filled chamber means located intermediate the first chamber means and the resilient liner.

57. The helmet of claim 54 in which at least a portion of the inner surfaces of said pads are spaced from the inner surface of the liner means.

58. The helmet of claim 54 in which the sides of said pads abut against sidewalls of the liner means defining said openings

59. A protective helmet, comprising: a shell, liner means of a flexible material having a plurality of hollow spaced members, and a resilient liner positioned intermediate the liner means and said shell, said resilient liner having a plurality of cutout portions to receive the spaced members of the liner means.

60. The helmet of claim 59 which the liner means has a plurality of openings at least partially defined by said spaced members, and in which portions of the resilient liner adjacent said cutout portions project into said openings.

61. The helmet of claim 60 in which at least a portion of the inner surfaces of the projecting liner portions are spaced from an inner surface of the liner means.

62. The helmet of claim 59 in which the resilient liner snugly receives the spaced members of said liner means.

63. The helmet of claim 59 in which the liner means has a plurality of hollow spoke members extending radially from an upper central portion of the liner means, and in which the resilient liner has a plurality of radially extending cutout portions to receive said spoke members.

64. The helmet of claim 63 in which said liner means has a hollow rim extending around a lower portion of the liner means and communicating with said spoke members, and in which the resilient liner includes a cutout portion to receive the rim.

65. The helmet of claim 63 in which said liner means includes a hollow annular member communicating with the spoke members adjacent an upper central portion of the liner means, and in which the resilient liner includes a cutout to receive the annular member.

66. The helmet of claim 59 wherein the liner means includes a first liner having first fluid filled chamber means, said a second liner positioned intermediate the first liner and said cutout portions and having second fluid filled chamber means.

* * * * *

UNITED STATES PATENT AND TRADEMARK OFFICE

CERTIFICATE OF CORRECTION

PATENT NO. : 3,994,021

DATED : November 30, 1976

INVENTOR(S) : Frank K. Villari, Carl J. Steigerwald and Frederick A. Rappleyea

It is certified that error appears in the above-identified patent and that said Letters Patent are hereby corrected as shown below:

Column 1, line 7, "of", second occurrence, should be -- or -- .

Column 2, line 53, "linrt" should be -- liner -- .

Column 2, line 59, "sweet" should be -- sweat -- .

Column 3, line 31, "sweet" should be -- sweat -- .

Column 3, line 60, "helment" should be -- helmet -- .

Column 4, line 4, "refelrring" should be -- referring -- .

-- .

Column 5, line 26, after "shore" insert -- A -- .

Column 5, line 42, "different" should be -- differing -- .

Column 11, line 30, "on", first occurrence, should be -- of --.

Column 13, line 39, "abuting" should be -- abutting --

Column 16, line 29, "the", second occurrence, should be -- a --.

UNITED STATES PATENT AND TRADEMARK OFFICE

CERTIFICATE OF CORRECTION

PATENT NO. : 3,994,021

DATED : November 30, 1976

INVENTOR(S) : Frank K. Villari, Carl J. Steigerwald and Frederick A. Rappleyea

It is certified that error appears in the above-identified patent and that said Letters Patent are hereby corrected as shown below:

Column 16, line 61, "frist" should be -- first -- .

Column 18, line 1, "linear" should be -- liner -- .

Signed and Sealed this

Fifteenth Day of March 1977

[SEAL]

*Attest:*

RUTH C. MASON
*Attesting Officer*

C. MARSHALL DANN
*Commissioner of Patents and Trademarks*